United States Patent [19]

Zoor

[11] Patent Number: 4,504,078

[45] Date of Patent: Mar. 12, 1985

[54] SKI BINDING WITH BIASING MEANS

[75] Inventor: Reinhold Zoor, Munich, Fed. Rep. of Germany

[73] Assignee: Heinrich Wunder GmbH KG, Dachau, Fed. Rep. of Germany

[21] Appl. No.: 351,476

[22] Filed: Feb. 23, 1982

[30] Foreign Application Priority Data

Mar. 3, 1981 [DE] Fed. Rep. of Germany ..... 3107884

[51] Int. Cl.[3] ..... A63C 9/02

[52] U.S. Cl. ..... 280/615

[58] Field of Search ..... 280/615, 614, 626, 628, 280/617, 618, 635, 631

[56] References Cited

U.S. PATENT DOCUMENTS

| | | | |
|---|---|---|---|
| 2,573,955 | 11/1951 | Cubberley | 280/631 |
| 3,961,802 | 6/1976 | Vannatter | 280/631 |
| 4,088,342 | 5/1978 | Hausleithner | 280/614 |
| 4,273,355 | 6/1981 | Storandt | 280/618 |
| 4,322,090 | 3/1982 | Loughney | 280/614 |

FOREIGN PATENT DOCUMENTS

| | | | |
|---|---|---|---|
| 2431438 | 1/1976 | Fed. Rep. of Germany | 280/614 |
| 2363341 | 3/1978 | France | 280/615 |
| 252152 | 9/1948 | Switzerland | 280/614 |

*Primary Examiner*—David M. Mitchell

*Attorney, Agent, or Firm*—Peter K. Kontler

[57] ABSTRACT

A ski binding includes a retainer for confining and supporting a ski boot. The retainer is pivotally mounted on a ski via a pivot located near the front of the binding. The retainer has a plate which is positioned near the front of the binding and serves to support a ski boot. The plate has a recess which accommodates a pair of springs. One end of each spring bears against a wall of the recess while the other end of each spring bears against a rod which extends into the recess. The end of the rod which is located outside of the recess is secured to a pivot which is located above or below the pivot for the retainer. The arrangement is such that the springs are stressed in tension or compression as the retainer is pivoted away from the ski thereby exerting a restoring moment on the retainer. The arrangement makes it possible to maintain the restoring moment essentially constant over the angular range which occurs during use. The springs are preferably stressed in compression in order to obtain increased life.

20 Claims, 9 Drawing Figures

SKI BINDING WITH BIASING MEANS

BACKGROUND OF THE INVENTION

The invention relates generally to a ski.

More particularly, the invention relates to a ski binding, especially a binding for a cross-country ski.

A known binding has a ski boot retainer, that is, a structure for supporting and confining a ski boot, which is pivotable about an axis located in the region of the toe of the boot.

When skiing in hilly terrain, it is desirable for the ski and the boot to be biased towards one another, especially during turns. This is accomplished by means of a spring.

In a conventional binding, the spring is a torsion spring which surrounds the axis of rotation of the ski boot retainer. One end of the spring bears against the ski while the other end of the spring bears against the retainer. Accordingly, when the retainer is pivoted away from the ski, the spring twists and is stressed in torsion.

The preceding design has the disadvantage that the life of a torsion spring is rather limited. Another disadvantage of this design resides in that the resistance to pivoting of the retainer increases with increasing angle of rotation since the stress in the spring increases as the retainer pivots away from the ski.

OBJECTS AND SUMMARY OF THE INVENTION

It is an object of the invention to provide a ski binding, especially for a cross-country ski, with improved means for biasing the ski and the ski boot retainer towards one another.

Another object of the invention is to provide a ski binding, especially for a cross-country ski, which makes it possible to increase the life of a means for biasing the ski and the ski boot retainer towards one another.

An additional object of the invention is to provide a ski binding, especially for a cross-country ski, which makes it possible to select the manner in which the restoring moment of a means for biasing the ski and the ski boot retainer towards one another varies with the angle of rotation.

A concomitant object of the invention is to provide a ski binding, especially for a cross-country ski, which enables the restoring moment of a means for biasing the ski and the ski boot retainer towards one another to remain substantially constant as the angle of rotation changes.

The preceding objects, and others which will become apparent as the description proceeds, are achieved by the invention.

One aspect of the invention resides in a combination which comprises a ski, especially a cross-country ski, and a binding secured to the ski. The binding includes pivot means defining a predetermined pivot axis and ski boot retaining means mounted for rotation on this axis between a first position in which the retaining means is located adjacent to the ski and a second position in which the retaining means is pivoted away from the ski. The binding further includes biasing means for biasing the retaining means from the second position to the first position. The biasing means includes a biasing element which is increasingly stressed in tension or compression as the retaining means moves from its first position to its second position.

The axis of rotation of the ski boot retaining means or retainer may be located in the region of the toe of the ski boot. The retainer may include a frame or plate for supporting the ski boot.

The biasing element may be a spring and may take the form of a rubber spring, a helical spring, an air cushion spring and so on.

According to a preferred embodiment of the invention, the biasing element is a compression spring. One end of the spring bears against the retainer at a location spaced from the axis of rotation of the latter and positioned between such axis and the trailing end of the ski. The other end of the spring exerts pressure against a pivot defining an axis of rotation which is fixed relative to the ski and is located above or below the axis or rotation of the retainer.

Since the life of a compression spring is longer than that of a torsion spring, the invention enables the life of the means for biasing the ski and the ski boot retainer towards one another to be substantially increased.

The manner in which the spring is compressed during rotation of the retainer may be influenced by appropriate selection of the spacing between the axis of rotation of the spring and the axis of rotation of the retainer. Furthermore, in the arrangement according to the invention, the spacing between the axis of rotation of the retainer and the line along which the spring force acts, and hence the magnitude of the restoring moment, vary continuously with the angle of rotation. Accordingly, the variation of the restoring moment with the angle of rotation of the retainer may be predetermined by suitable selection of the position of the axis of rotation of the spring relative to that of the retainer.

If the axis of rotation of the spring is located below the axis of rotation of the retainer and the spring is to be compressed, it is necessary to provide a tension rod between the spring and its pivot. The tension rod engages the end of the spring remote from the pivot. The tension rod is required since direct engagement of the spring with its pivot when the axis of rotation of the spring is located below that of the retainer would result in extension of the spring during rotation of the retainer. The spring would then act as a tension spring. It is to be mentioned that the invention contemplates the use of a tension spring if one having an adequate life span is available so that a compression spring is not required for long life and the function of the spring is to influence the variation of the restoring moment with the angle of rotation of the retainer. In such a case, the spring may engage its pivot directly if the axis of rotation of the spring is below that of the retainer so that the spring will act as a tension spring.

In accordance with an advantageous embodiment of the invention, the axis of rotation of the spring is located between the axis of rotation of the retainer and the leading end of the ski. Here, the dead position, that is, the position in which no restoring moment is exerted on the retainer, occurs in an angular range which cannot be achieved during skiing. For example, if the axis of rotation of the spring is positioned directly above the axis of rotation of the retainer, the dead position occurs at an angle of 90° or, in other words, when the retainer and the ski are normal to one another. Although the maximum degree of compression of the spring is achieved at this position, the restoring moment is zero since the spacing between the axis of rotation of the retainer and the line along which the spring force acts is zero, that is, the axis of rotation of the retainer and such line are located in a common plane. If the axis of rotation of the spring is moved towards the rear of the ski so that it is located between the axis of rotation of the retainer and the trailing end of the ski, the dead position occurs at an angle of less than 90°.

The spring may be arranged internally of the retainer, e.g. internally of a plate or crosspiece which constitutes part of the retainer and functions to support the sole of a ski boot. In such an event, it is favorable for the end of the spring nearest the leading end of the ski to bear against a rod which, in turn, is secured to the pivot for the spring. As mentioned previously, it is always necessary to provide a rod between the spring and its pivot when the axis of rotation of the spring is located below that of the retainer and the spring is to function as a compression spring.

The invention is not limited to the use of a single spring. Thus, the restoring moment can be generated using a plurality of individual springs which are arranged parallel to one another.

According to another embodiment of the invention, means is provided for adjusting the prestress of the spring.

The novel features which are considered as characteristic of the invention are set forth in particular in the appended claims. The improved ski binding itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
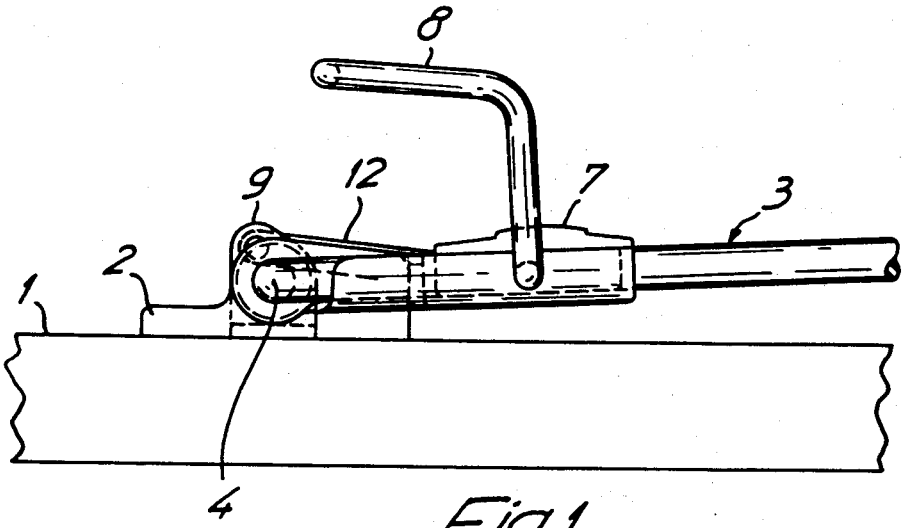
FIG. 1 is a side view of one embodiment of a ski binding in accordance with the invention.
Figure 2:
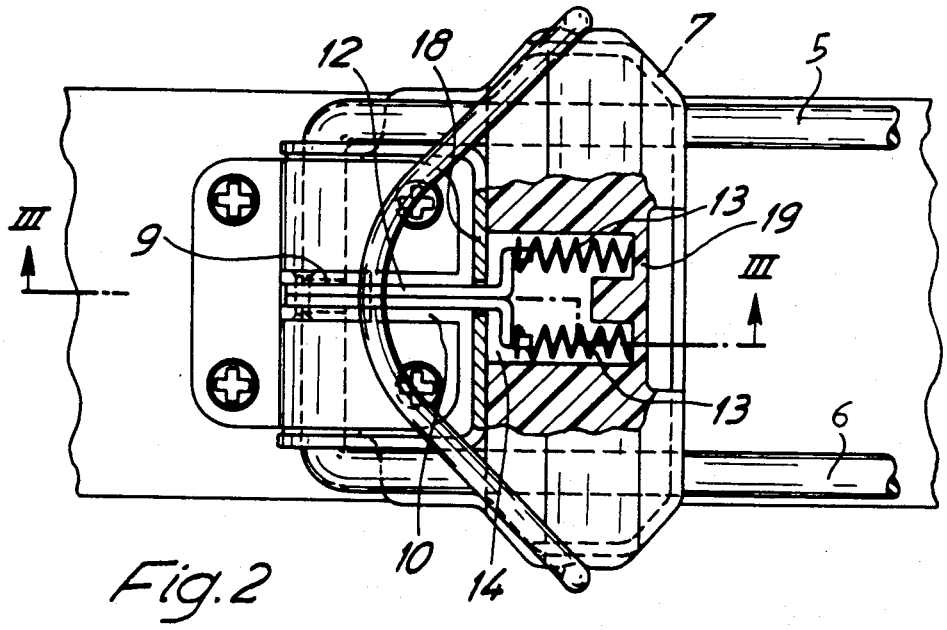
FIG. 2 is a partly sectional plan view of the ski binding of FIG. 1.

FIGS. 1–4 illustrate a ski 1 which is here assumed to be a cross-country ski. The leading end or front of the ski 1 is on the left-hand side as seen in FIGS. 1–4 while the trailing end or rear of the ski 1 is on the right-hand side.

The ski 1 carries a bearing member 2. The bearing member 2 supports a pivot 4, and a ski boot retainer 3, that is, a structure for supporting and confining a ski boot, is pivotally mounted on the pivot 4. The retainer 3 includes a frame having a pair of legs 5 and 6 which are bridged by and secured to a plate or crosspiece 7 located in the forward region of the retainer 3. The uppermost portion of the plate 7 projects above the legs 5 and 6. The plate 7 serves to support the front portion of the sole of a ski boot. The plate 7 carries a confining member 8 which functions to arrest or confine the front portion or toe of a ski boot. The confining member 8 is in the form of a wire yoke which is pivotally mounted on the plate 7.

Although the retainer 3 is here shown as having a frame 5–7 for supporting a ski boot, it is possible to replace the frame 5–7 by a plate.

The rear portion of the ski binding, which includes the rear confining member and the release mechanism, has not been illustrated since this is not necessary for an understanding of the invention.

The bearing member 2 has a groove 10 and a U-shaped bearing element 9 is mounted in the groove 10. The bearing element 9 carries a pivot 11. One of the ends of a rod 12 is secured to the pivot 9 so that the rod 12 is rotatable on the pivot 9. The opposite end of the rod 12 is fork-like and is provided with a pair of tines.

The plate 7 is provided with an internal recess 14. The front of the recess 14 is bounded by a wall 18 while the rear of the recess 14 is bounded by a wall 19. A pair of parallel compression springs 13 is arranged inside the recess 14 and the rear ends of the springs 13 bear against the rear wall 19 of the recess 14. The rod 12 extends through an opening provided in the front wall 18 of the recess 14 so that the tines of the rod 12 are accommodated in the recess 14. The front ends of the springs 13 respectively engage the tines of the rod 12. The rod 12 thus provides a connection between the springs 13 and the pivot 11.

Figure 3:
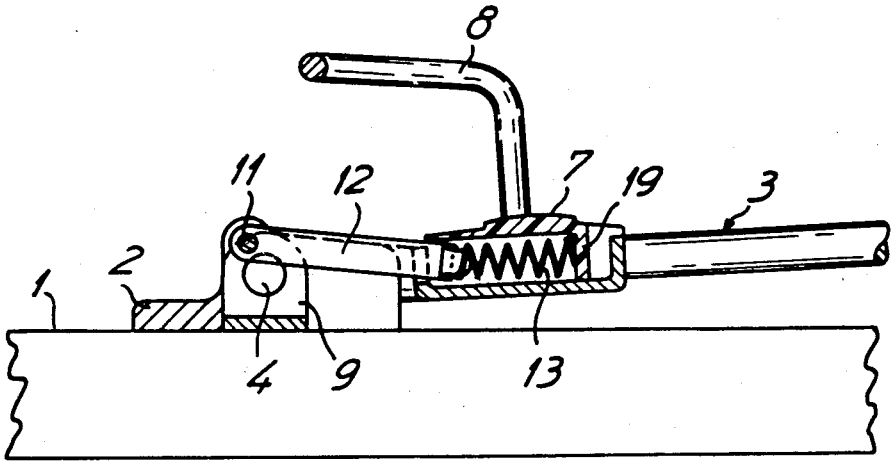
FIG. 3 is a sectional view as seen in the direction of the arrows III—III of FIG. 2.
Figure 4:
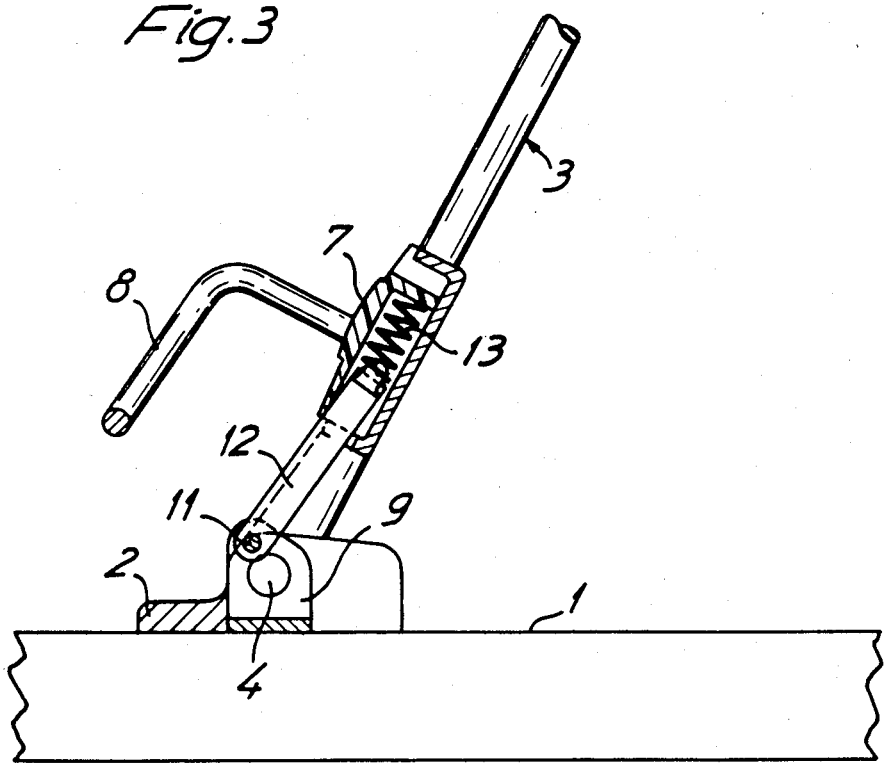
FIG. 4 shows the ski binding of FIG. 3 but pivoted to a different position.

FIG. 3 illustrates the retainer 3 in a horizontal position adjacent to the ski 1 while FIG. 4 shows the retainer 3 after it has been pivoted upwardly away from the ski 1. It will be observed from FIGS. 3 and 4 that the pivot 11 is located above the pivot 4 and that the springs 13 are accordingly compressed as the retainer 3 is pivoted away from the ski 1.

The maximum angle which the retainer 3 makes with the ski 1 during skiing is essentially 90°. In this regard, it will be observed that the pivot 11 is offset relative to the pivot 4 in a direction towards the leading end of the ski 1. This has the result that the dead position in which the retainer 3 lies in the plane defined by the pivots 4 and 11, and in which the springs 13 thus do not exert a restoring moment on the retainer 3, occurs at an angle in excess of 90°. While it is true that the maximum compression of the springs 13 occurs in the dead position, the moment arm is nevertheless zero so that the restoring moment is likewise zero. The maximum amount by which the springs 13 are compressed equals the distance between the centers of the pivots 4 and 11.

As the retainer 3 is pivoted away from the position illustrated in FIG. 3, the springs 13 are increasingly compressed and the force exerted by the springs 13 increases continuously. However, the moment arm via which the springs 13 exert a moment on the retainer 3 about the pivot 4 continuously decreases with increasing angle of rotation. Accordingly, it is possible to maintain the restoring moment substantially constant over the entire angular range which occurs during use.

When the pivot 11 for the springs 13 is positioned as shown in FIGS. 1–4, it is possible to mount a spring retaining element or plate on the pivot 11 and to dispense with the rod 12. In other words, the rod 12 may be replaced by springs which constitute extensions of the springs 13, that is, the springs 13 may extend all the way to the pivot 11.

Figure 5:
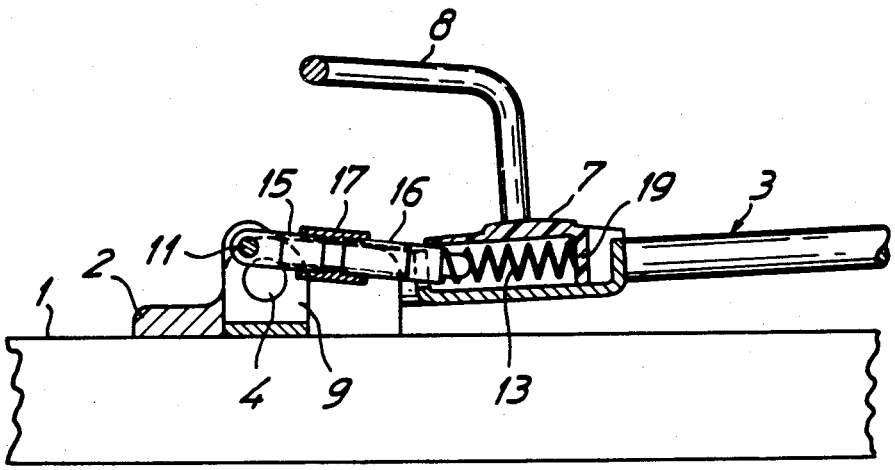
FIG. 5 is a sectional side view of another embodiment of a ski binding according to the invention.
Figure 6:
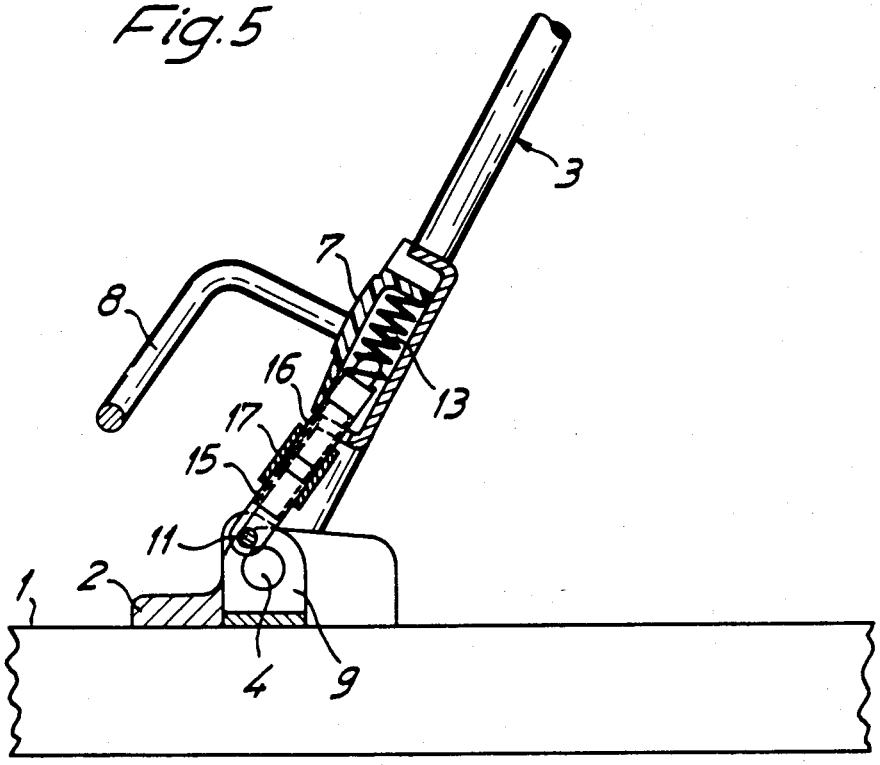
FIG. 6 shows the ski binding of FIG. 5 but pivoted to a different position.

FIGS. 5 and 6 illustrate an embodiment which is similar to that of FIGS. 1–4. However, the rod 12 of FIGS. 1–4 is replaced by a pair of axially aligned rods 15 and 16 in FIGS. 5 and 6. The rod 15 is mounted on the pivot 11 whereas the rod 16 has a pair of tines which engage the springs 13. The ends of the rods 15 and 16 which are located adjacent to one another are externally threaded and are received in an internally threaded sleeve 17. This arrangement makes it possible to prestress the springs 13 as desired.

Figure 8:
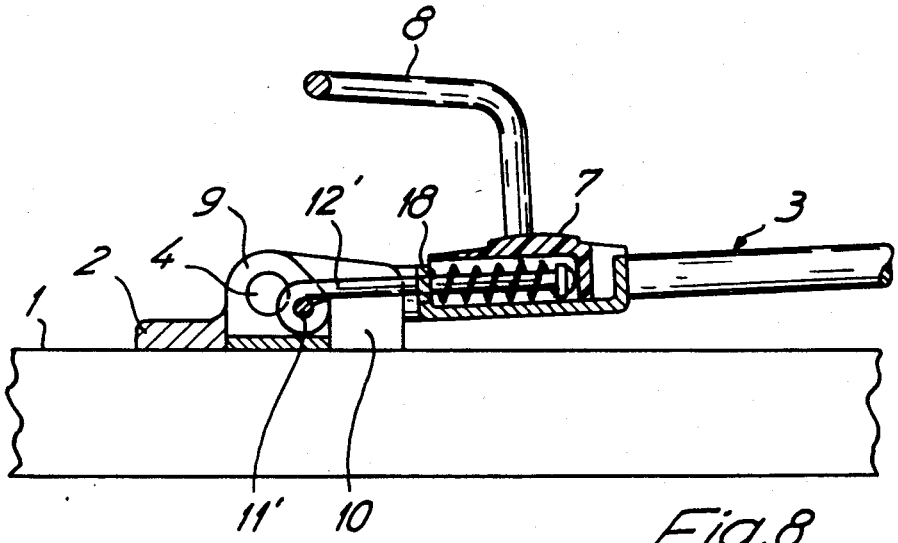
FIG. 8 is a sectional view as seen in the direction of the arrows VIII—VIII of FIG. 7.
Figure 7:
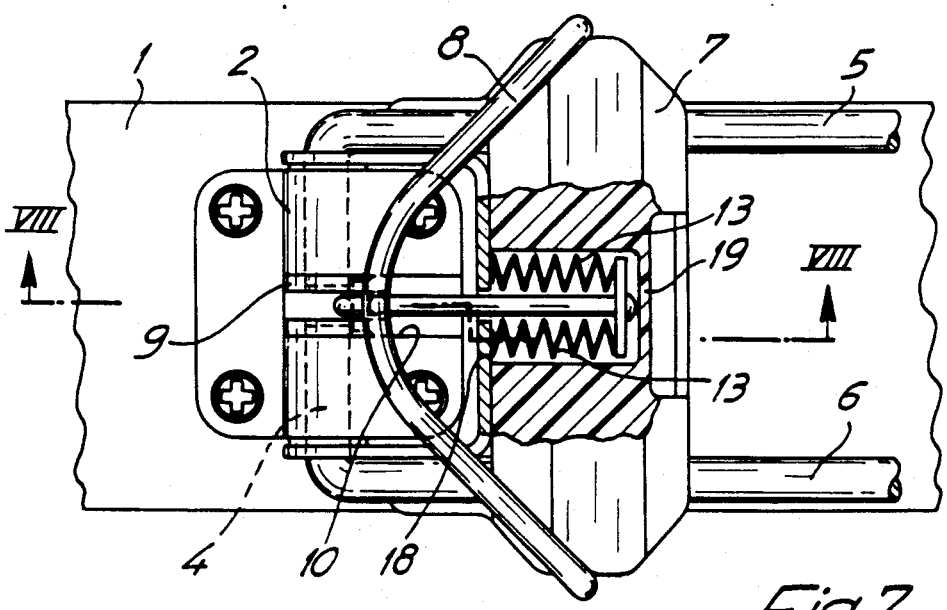
FIG. 7 is a partly sectional plan view of an additional embodiment of a ski binding according to the invention.
Figure 9:
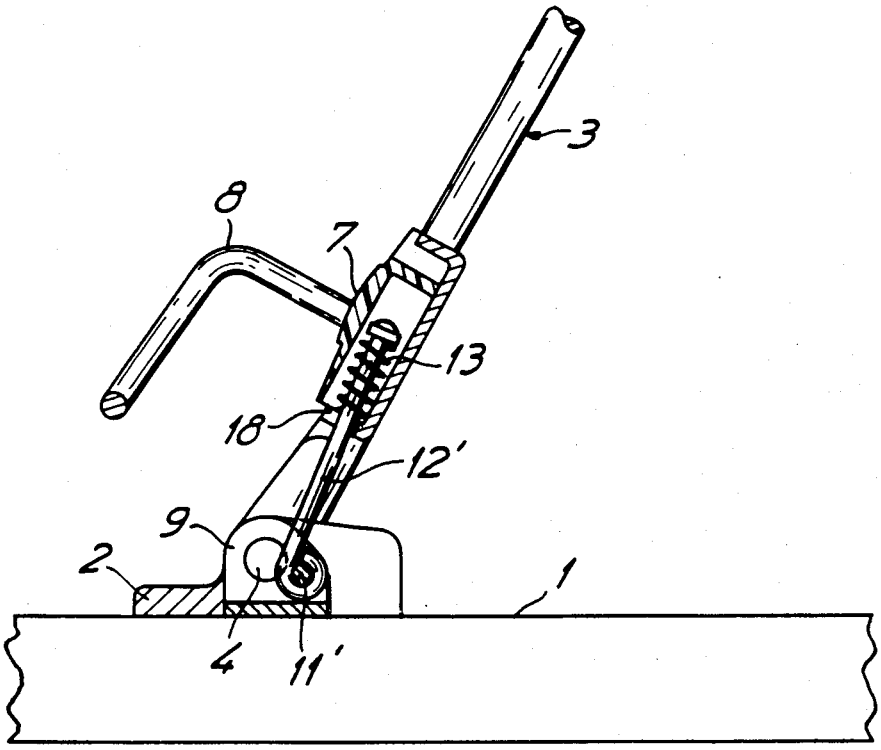
FIG. 9 shows the ski binding of FIG. 8 but pivoted to a different position.

FIGS. 7–9 illustrate another embodiment which is similar to that of FIGS. 1–4 except that here the pivot for the springs 13 is identified by the reference numeral 11′ and is located below the pivot 4 for the retainer 3. If the rear ends of the springs 13 in FIGS. 7–9 were to bear against the rear wall 19 of the cavity 14 and the front ends of the springs 13 were to bear against the rod 12 of FIGS. 1–4, the springs 13 would undergo an extension during rotation of the retainer 3 from the horizontal position indicated in FIG. 8 to the pivoted position shown in FIG. 9. The springs 13 would then act as tension springs which is acceptable under certain circumstances but not under others.

In order that the springs 13 of FIGS. 7–9 may function as compression springs, the springs 13 are arranged so that the front ends thereof bear against the front wall 18 of the recess 14. The rod 12 of FIGS. 1–4 is replaced by a rod 12′ which is connected to the pivot 11′. The end of the rod 12′ remote from the pivot 11′ is provided with a washer rather than with tines. The washer bears against the rear ends of the springs 13 and the latter are confined between the washer and the front wall 18 of the recess 14. The springs 13 are thus compressed during rotation of the retainer 3 from the position illustrated in FIG. 8 since the washer travels along an arc having a smaller radius than that followed by the corresponding portion of the retainer 3.

In the embodiments of FIGS. 1–6, the springs 13 bear against the rear wall 19 of the recess 14 whereas the rear wall 19 is not subjected to load in the embodiment of FIGS. 7–9.

It will be observed that the pivots 4 and 11 of FIGS. 1–6, as well as the pivots 4 and 11′ of FIGS. 7–9, define a plane which intersects the ski 1. In other words, neither the pivots 4 and 11 nor the pivots 4 and 11′ lie in a plane which is parallel to the ski 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A binding for a cross-country ski comprising:

(a) ski boot retaining means having first means defining a first pivot axis in the region of the toe, and second means defining a second pivot axis, said retaining means being pivotally mountable on a ski for rotation on said first axis between a first position in which said retaining means is located adjacent to the ski and a second position in which said retaining means is pivoted away from the ski, and said second axis being fixed relative to the ski when said retaining means is mounted thereon and being spaced from the upper surface of the ski by a different distance than said first axis as considered in a direction normal to the upper surface of the ski; and (b) biasing means for biasing said retaining means from the second position to the first position, said biasing means including a biasing element having opposite ends, and one of said ends being arranged to exert a force against said retaining means while the other of said ends is connected with and arranged to exert a force against a pivot located on said second axis, said one end being disposed between said first axis and the trailing end of the ski at least when said retaining means is in its first position, and said biasing element being designed to undergo a change in length during movement of said retaining means between the first and second positions.

2. A binding as defined in claim 1, wherein said second axis is located between said first axis and the leading end of the ski when said retaining means is mounted on the ski.

3. A binding as defined in claim 1, wherein said element is stressed in compression as said retaining means moves from the first position to the second position.

4. A binding as defined in claim 3, wherein said element is a compression spring.

5. A binding as defined in claim 1, wherein said element is a spring.

6. A binding as defined in claim 1, wherein said retaining means comprises a confining member for the front of a boot in the region of said first axis.

7. A binding as defined in claim 1, wherein said retaining means comprises a frame.

8. A binding as defined in claim 1, wherein said retaining means comprises a plate.

9. A binding as defined in claim 1, wherein said second axis is located between said first axis and the trailing end of the ski when said retaining means is mounted on the ski.

10. A binding as defined in claim 1, wherein said one end directly contacts said retaining means.

11. A binding as defined in claim 1, comprising means for prestressing said biasing element.

12. A binding as defined in claim 1, wherein said second axis is located above said first axis.

13. A binding as defined in claim 1, wherein said second axis is located below said first axis.

14. A binding as defined in claim 1, comprising a rod which is arranged to engage a pivot located on said second axis, said other end of said element bearing against said rod.

15. A binding as defined in claim 14, wherein said other end of said element is arranged to be located between said one end thereof and the leading end of the ski at least in the first position of said retaining means.

16. A binding as defined in claim 14, wherein said one end of said element is arranged to be located between said other end thereof and the leading end of the ski at least in the first position of said retaining means.

17. A binding as defined in claim 1, wherein said retaining means comprises a support member for the sole of a boot and said element is located in said support member.

18. A binding as defined in claim 17, wherein said support member comprises a plate.

19. A binding as defined in claim 17, wherein said support member comprises a crosspiece extending transversely and connecting opposite sides of said retaining means.

20. A binding as defined in claim 1, wherein said biasing means comprises a plurality of parallel biasing elements which are stressed in tension or compression as said retaining means moves from the first position to the second position.

* * * * *